United States Patent [19]

Yamamoto

[11] Patent Number: 4,930,432

[45] Date of Patent: Jun. 5, 1990

[54] BOBBIN THREAD HOLDING DEVICE FOR LOCK STITCH SEWING MACHINE CUTTER

[75] Inventor: Yuji Yamamoto, Chofu, Japan

[73] Assignee: Juki Corporation, Tokyo, Japan

[21] Appl. No.: 274,377

[22] Filed: Nov. 21, 1988

[30] Foreign Application Priority Data

Nov. 30, 1987 [JP] Japan ..... 62-303725

[51] Int. Cl.[5] ..... D05B 65/02

[52] U.S. Cl. ..... 112/292; 112/191; 112/260

[58] Field of Search ..... 112/191, 292, 298, 260

[56] References Cited

U.S. PATENT DOCUMENTS 3,386,402 6/1968 Ross ..... 112/292

4,077,342 3/1978 Steckenrider ..... 112/292

4,586,449 5/1986 Raupach ..... 112/292

*Primary Examiner*—Andrew M. Falik

*Attorney, Agent, or Firm*—Morgan & Finnegan

[57] ABSTRACT

A bobbin thread holding device for a lockstitch sewing machine adapted to temporarily form an entrapping hole under a throat plate wherein a bobbin thread is captured. A recess provided at the sidewall of the throat plate and a hook with a crooked portion at one end form the entrapping hole. A movable blade, provided underneath the throat plate, moves to cut the bobbin thread. In cooperation with the motion of the movable blade, the hook picks up the bobbin thread and, as the bobbin thread is held in the entrapping hole, the bobbin thread is crossed with a needle thread loop.

6 Claims, 7 Drawing Sheets

BOBBIN THREAD HOLDING DEVICE FOR LOCK STITCH SEWING MACHINE CUTTER

BACKGROUND OF THE INVENTION

The present invention relates to a lock stitch sewing machine equipped with a horizontally rotating shuttle. More particularly, the present invention relates to a device for temporarily holding the severed end of a bobbin thread after the bobbin thread is cut such that the bobbin thread is securely engaged and crossed with a needle thread.

Referring to FIG. 11, one conventional way of holding a severed end of a bobbin thread after cutting will be explained. Numeral 101 denotes a throat plate, 102 denotes a movable blade, 103 denotes a bobbin, 104 denotes a stationary blade, 105 denotes a plate spring, and 107 denotes a shuttle. Symbol N denotes a needle, $I_1$ denotes a bobbin thread, $I_2$ denotes a needle thread.

When the stitching is finished, the movable blade 102 moves rightward and draws the bobbin thread $I_1$ from the bobbin 103 by a predetermined length so the bobbin thread $I_1$ is clamped between the movable blade 102 and the plate spring 105. As the movable blade 102 moves further rightward, the bobbin thread $I_1$ is cut by the movable blade 102 and the stationary blade 104.

Since the severed end of the bobbin thread $I_1$ is held between the movable blade 102 and the plate spring 105 as shown in FIG. 11 and FIG. 12, when the next stitching starts, a loop formed around the needle N passes over the bobbin 103 and crosses with the bobbin thread $I_1$. Thus, the stitching is conducted.

Referring to FIG. 12, since the bobbin thread $I_1$ is held between the movable blade 102 and the plate spring 105, the spring pressure of the plate spring 105 must be adjusted to meet the thread diameter and the friction coefficient of the thread. Accordingly, such adjustment work lowers sewing productivity.

If the bobbin thread diameter is small and the plate spring is adjusted to a large diameter bobbin thread, the bobbin thread will easily slip off of the plate spring in direction of arrows A, B in FIG. 12. Conversely, if the bobbin thread is large and the plate spring is adjusted to a small diameter bobbin thread, the bobbin thread $I_1$ will be tightly clamped by the plate spring and will not be separated, and the subsequent stitching will be incomplete.

SUMMARY OF THE INVENTION

With the foregoing in mind, it is an object of the invention to provide a bobbin thread holding device which holds the severed end of the bobbin thread securely, regardless of variation in thread, after cutting the bobbin thread.

In accordance with the instant invention, a thread holder is provided adjacent to the bottom of the throat plate and the thread holder is adapted to open and close in association with motion of a movable blade such that the bobbin thread is received into the thread holder when it opens and is held when it closes. Thereby, when the bobbin thread is cut, its severed end is held securely in the thread holder, and the next stitching work can be securely started without skipping any stitches.

BRIEF DESCRIPTION OF THE DRAWINGS

The accompanying drawings, referred to herein and constituting a part hereof, illustrate preferred embodiments of the invention and, together with the description, serve to explain the principles of the invention, wherein:

FIG. 5A is a plan view of only the movable blade and the stationary blade shown in FIG. 5 and illustrates catching both the needle thread and the bobbin thread;

FIG. 5B is a side view of FIG. 5, showing only essential portions of the embodiment of the invention shown in FIG. 5;

DETAILED DESCRIPTION OF THE DRAWINGS

Referring to the accompanied drawings from FIG. 1 to FIG. 11, one preferred embodiment of the invention will be explained. Of the above-mentioned drawings, FIG. 4, FIG. 5, FIG. 6 will best serve to explain the essence of the invention.

Numeral 8 denotes a throat plate and provides a side wall 9 projected from the throat plate. The side wall 9 provides a recess 9*a*. Numeral 10 denotes a rotatable hook and provides a crooked hook 10*a* at its end. The rotatable hook 10 is urged to move upward by a plate spring 12 and is stopped by a stopper 13.

Figure 1:
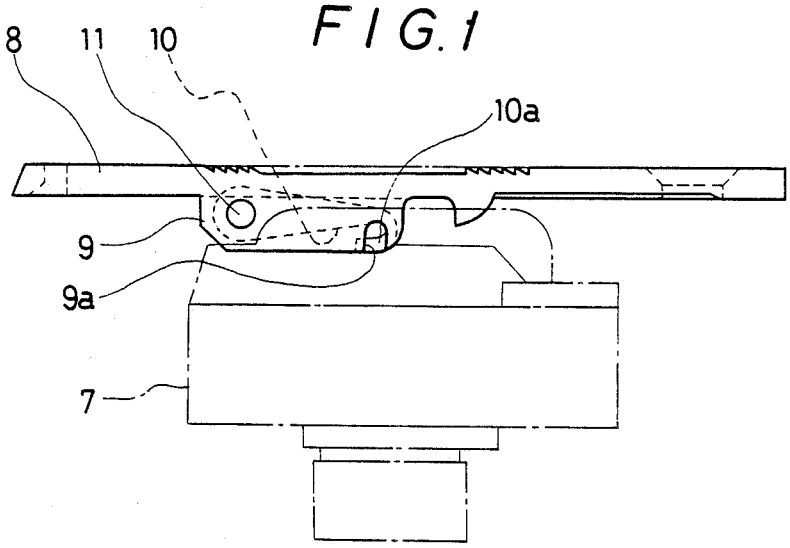
FIG. 1 is a side view of a bobbin thread holding device according to the present invention.
Figure 2:
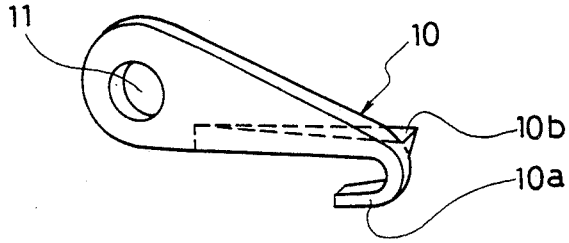
FIG. 2 is an enlarged perspective view of the rotatable hook shown in FIG. 1.
Figure 3:
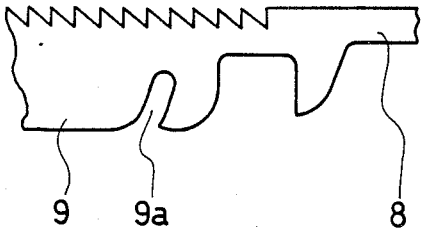
FIG. 3 is an enlarged side view of the throat plate shown in FIG. 1.

Referring to FIG. 2, the rotatable hook 10 provides a projected step 10*b* at its side wall. Numeral 14 denotes a stationary blade, 15 denotes a movable blade. The movable blade 15 is adapted to move against the stationary blade 14 and provides a curved surface 15*a* which contacts with the step 10*b* slidably when it is moved leftward.

Figure 4:
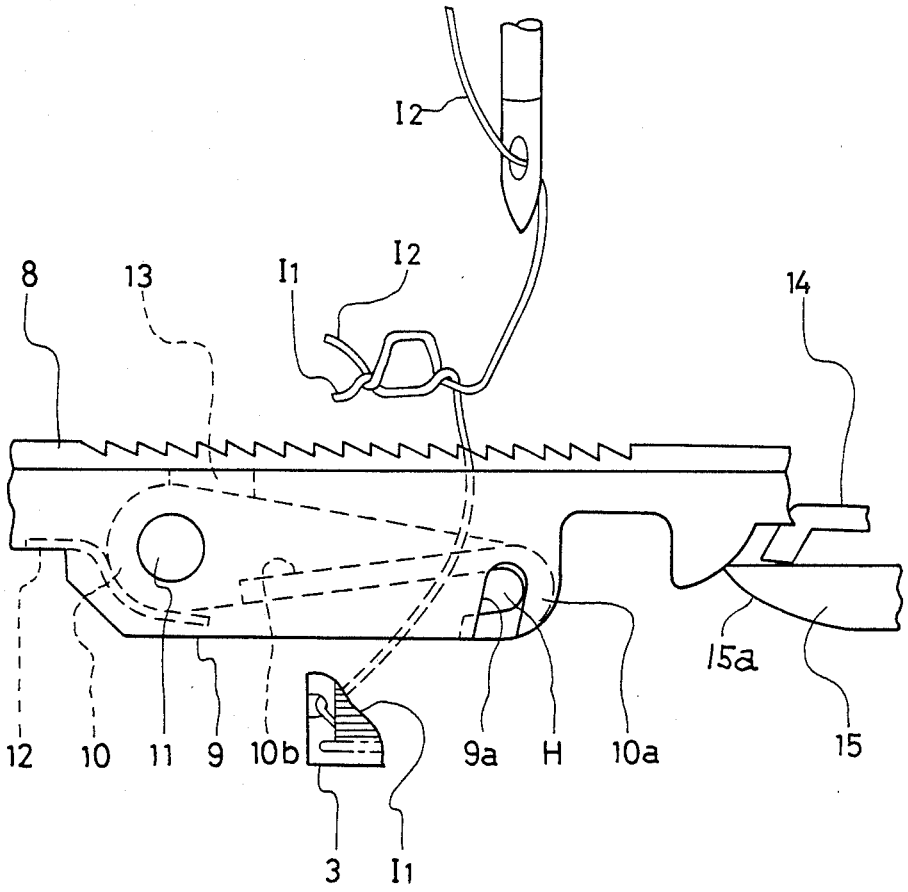
FIG. 4 is a side view of a bobbin thread holding device during stitching according to one embodiment of the present invention.
Figure 5:
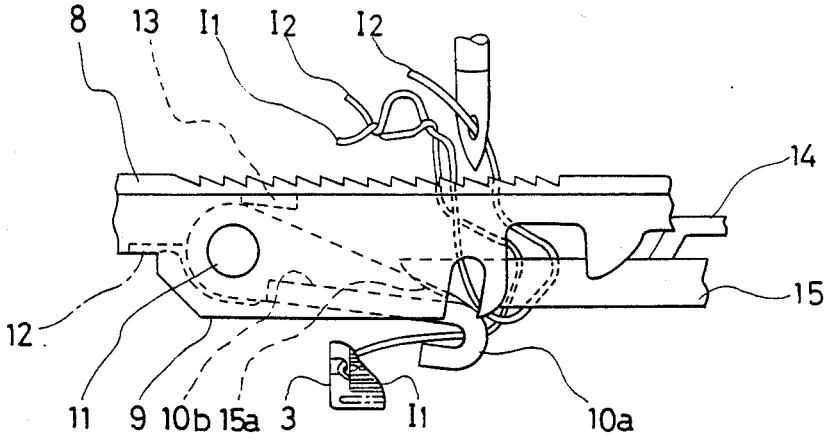
FIG. 5 is a side view of a bobbin thread holding device at the start of cutting the bobbin thread according to one embodiment of the present invention.
Figure 5:
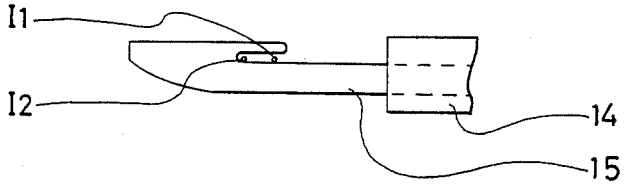
Figure 5:
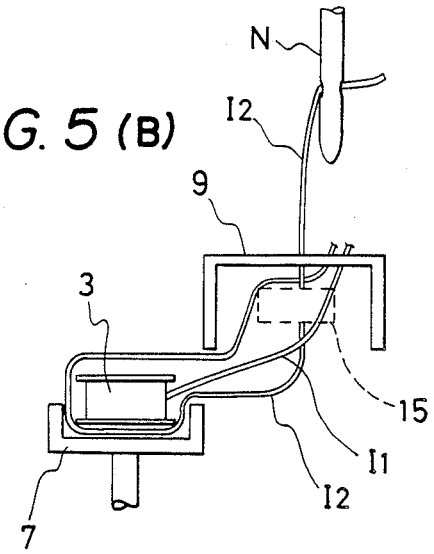

In the above-described bobbin thread holding device, when the stitching is finished (by way of operator's pedal action or computer program), the movable blade 15 moves leftward from the position shown in FIG. 4 by biasing means (e.g, magnetic action). Thus, the movable blade 15 catches the bobbin thread as shown in FIG. 5 and FIG. 5A. FIG. 5A is a top view drawing of the movable blade 15 shown in FIG. 5.

When the movable blade 15 moves leftward, the rotatable hook 10 rotates clockwise resisting against the force of the plate spring 12 since the rotatable hook 10 is pushed by the curved surface 15*a* of the movable blade 15 as shown in FIG. 5. As the rotatable hook 10 rotates further clockwise, the bobbin thread $I_1$ is caught in the crooked portion 10*a* as shown in FIG. 5. Thereafter, the movable blade 15 moves rightward to cut the bobbin thread $I_1$ and the needle thread $I_2$, positioned in the recess portion of the movable blade 15 as shown in FIG. 5A. Simultaneously, the rotatable hook 10 rotates counterclockwise by the force of the spring 12 and resumes its original position as shown in FIG. 4 since the pushing by the movable blade 15 is released.

Figure 6:
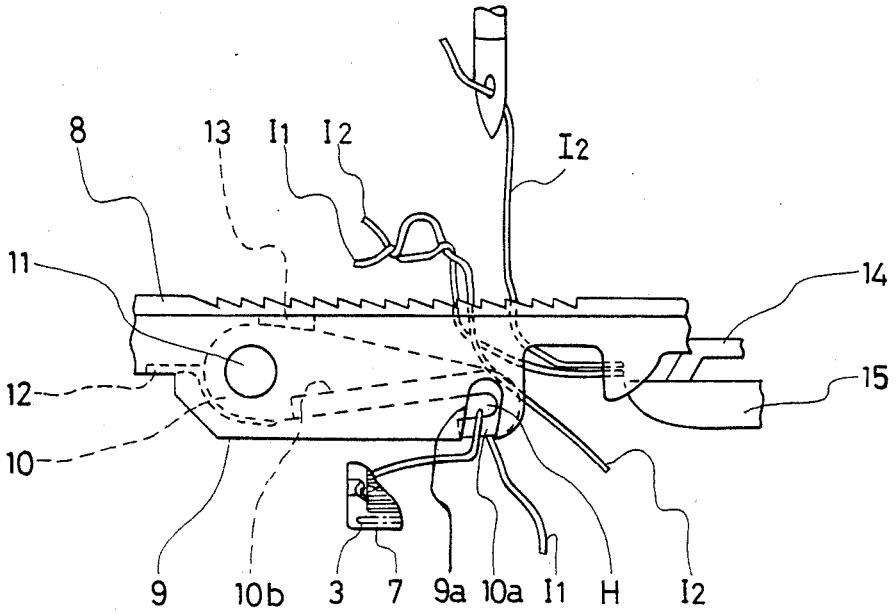
FIG. 6 is a side view drawing of a bobbin thread holding device just after cutting the bobbin thread according to one embodiment of the present invention.

When the rotatable hook rotates counterclockwise, the bobbin thread $I_1$ is securely captured in a temporarily formed enclosed hole H as shown in FIG. 6. The hole H is formed by the recess 9*a* and the crooked portion 10*a*, and the rotatable hook 10 is in slidable contact with the side wall 9 of the throat plate 8, so the bobbin thread is captured in the hole H. The bobbin thread $I_1$ is cut by the movable blade 15 and the stationary blade 14 as shown in FIG. 6, and the severed end of the bobbin thread $I_1$ hangs on the hole H. Thus, the bobbin thread $I_1$ is held in the temporarily formed hole H.

Figure 6A:
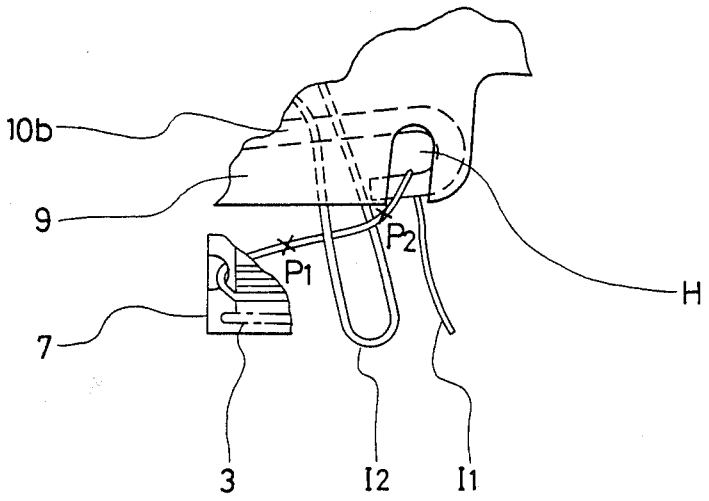
FIG. 6A is a partially enlarged view of FIG. 6 showing how the hanging bobbin thread $I_1$ is slipped off from the hole H, and how and where the bobbin thread $I_1$ and the needle thread $I_2$ are crossed.

Referring to FIG. 6A, when next stitching starts, a needle thread $I_2$ forms a loop when it is hooked by a shuttle 7 and this loop crosses with the bobbin thread $I_1$ at somewhere between $P_1$ and $P_2$ in FIG. 6A. The bobbin thread $I_1$ captured in the hole H as the needle thread $I_2$ moves up, and positions as shown in FIG. 4, and the stitching will be conducted without skipping of stitches.

Figure 7:
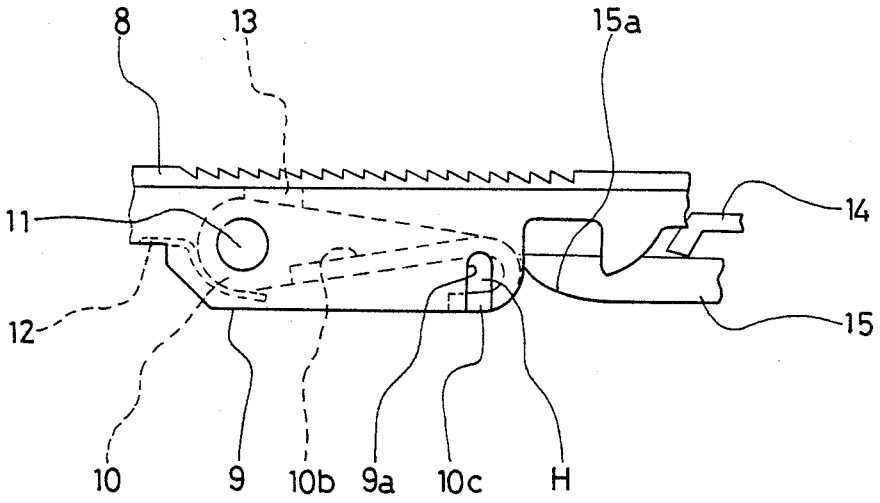
FIG. 7 is a side view of a bobbin thread holding device according to another embodiment of the present invention.
Figure 8:
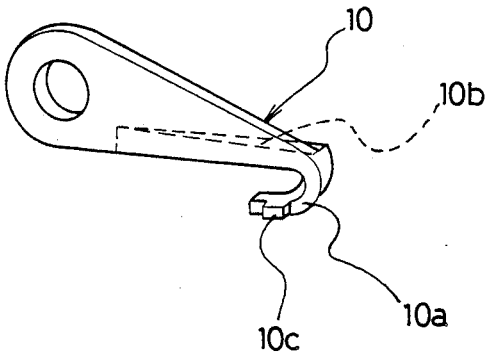
FIG. 8 is a partially enlarged perspective view drawing of the rotatable hook shown in FIG. 7.

Referring to FIG. 7 and FIG. 8 other embodiments of the present invention will be explained.

Referring to FIG. 8, the crooked portion 10*a* provides a projection 10*c* which slidably engages into the recess 9*a* such that the hole H is formed. In this embodiment, friction between side surface of the rotating hook and the side wall 9 is avoided, so the rotatable hook 10 is smoothly rotated without friction.

Figure 9:
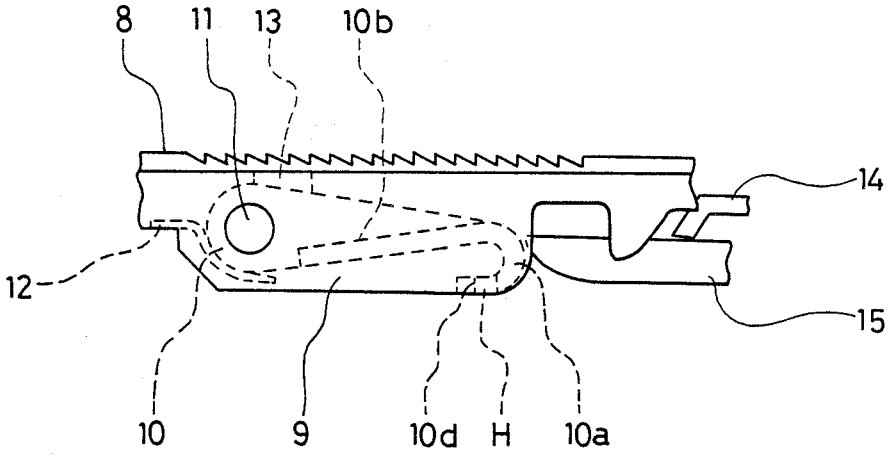
FIG. 9 is a side view drawing of a bobbin thread holding device according to another embodiment of the present invention.
Figure 10:
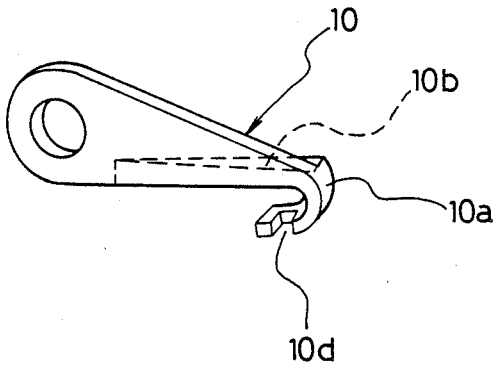
FIG. 10 is a partially enlarged perspective view drawing of the rotatable hook shown in FIG. 9.
Figure 11:
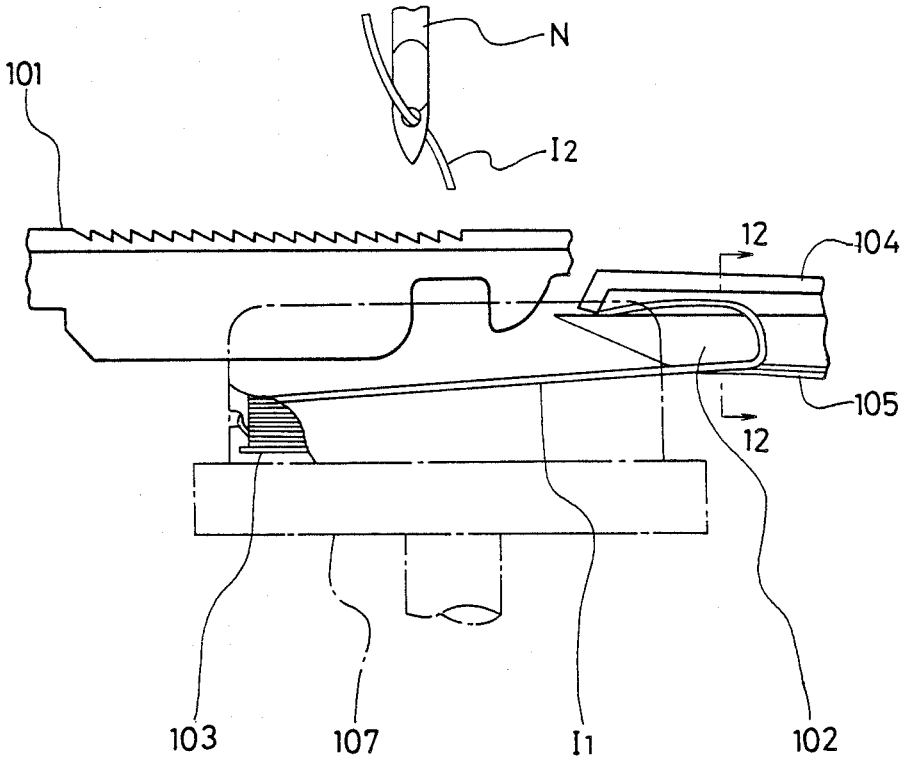
FIG.11 (PRIOR ART)
FIG. 11 is a side view drawing of a convention lock stitch sewing machine equipped with a horizontal shuttle showing essential portions related to the present invention, namely, a throat plate, a movable blade, a stationary blade and a shuttle.
Figure 12:
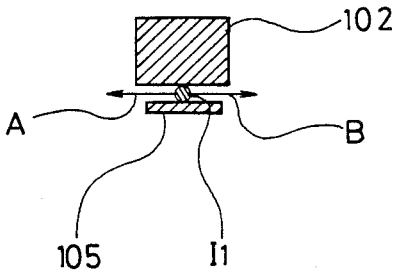
FIG.12 (PRIOR ART)
FIG. 12 is a partial enlarged sectional view along line 12—12 of FIG. 11 showing a bobbin thread clamped between a movable thread and a plate spring.

Referring to FIG. 10, the crooked portion 10*a* provides a recess 10*d*, and thereby, referring to FIGS. 6 and 9, the recess 9*a* is eliminated because the bobbin thread $I_1$ is captured in the hole H tentatively formed between the side wall 9 and the rotatable hook.

As discussed above, according to the present invention, the needle thread $I_1$ is securely held, regardless of the variation of thread, namely its diameter, material and friction coefficient. Accordingly, when stitching starts again, the skipping of stitches is avoided, and work efficiency is very much improved.

While the invention has been described in its preferred embodiments, it is to be understood that the words which have been used are words of description, rather than limitation, and that changes may be made within the purview of the appended claims without departing from the true scope and spirit of the invention in its broader aspects.

What is claimed:

1. A thread cutting device for a lockstitch sewing machine having a throat plate and bobbin, comprising:

a stationary blade positioned under the throat plate;

a movable blade for catching a needle thread and a bobbin thread to cut both threads in cooperation with said stationary blade; and holding means positioned between said movable blade and the bobbin defining an enclosed hole for insertion of said bobbin thread therethrough and to hold the bobbin thread caught by said movable blade.

2. A thread cutting device for a lockstitch sewing machine according to claim 1 wherein said holding means comprises:

a sidewall mounted on the throat plate; and a hook for hooking said bobbin thread caught by said movable blade and being vertically movable to cooperate with said sidewall to define said hole.

3. A thread cutting device for a lockstitch sewing machine according to claim 2 further comprising a spring for vertically biasing said hook, and wherein said movable blade includes a curved portion for pushing said hook against said spring when said movable blade moves to catch said threads.

4. A thread cutting device for lockstitch sewing machine to either of claims 2 or 3 wherein said sidewall includes a notch cooperating with said hook to define said hole.

5. A thread cutting device for a lockstitch sewing machine according to either of claims 2 or 3 wherein said hook includes a recess cooperating with said sidewall to define said hole.

6. A thread cutting device for a lockstitch sewing machine according to claims 2 or 3 wherein said hook includes a projection cooperating with said sidewall to define said hole.

* * * * *